United States Patent [19]

Bohler et al.

[11] Patent Number: 4,841,835

[45] Date of Patent: Jun. 27, 1989

[54] SAFETY APPARATUS FOR AN EXTERNALLY POWERED FIRING WEAPON

[75] Inventors: Erwin Bohler, Dübendorf; Werner Bruderer, Zürich, both of Switzerland

[73] Assignee: Werkzeugmaschinenfabrik Oerlikon-Bührle AG, Zürich, Switzerland

[21] Appl. No.: 142,699

[22] Filed: Jan. 11, 1988

[30] Foreign Application Priority Data

Jan. 16, 1987 [CH] Switzerland ..... 00146/86

[51] Int. Cl.[4] ..... F41F 11/00; F41D 7/02

[52] U.S. Cl. ..... 89/12; 89/11

[58] Field of Search ..... 89/9, 11, 12, 185

[56] References Cited

U.S. PATENT DOCUMENTS

| | | | |
|---|---|---|---|
| 3,772,959 | 11/1973 | Tassie | 89/12 |
| 3,776,416 | 12/1973 | Ashley et al. | 89/12 |
| 3,921,499 | 11/1975 | Ginsky | 89/12 |
| 4,131,052 | 12/1978 | Skahill | 89/11 |
| 4,154,143 | 5/1979 | Pechamat et al. | 89/11 |
| 4,193,335 | 3/1980 | Tassie | 89/11 |
| 4,301,710 | 11/1981 | Kirkpatrick | 89/12 |
| 4,550,641 | 11/1985 | Bruderer et al. | 89/12 |
| 4,699,040 | 10/1987 | Menges | 89/11 |

FOREIGN PATENT DOCUMENTS

| | | |
|---|---|---|
| 0111240 | 6/1984 | European Pat. Off. . |
| 719180 | 3/1935 | Fed. Rep. of Germany . |

*Primary Examiner*—Daivd H. Brown

*Attorney, Agent, or Firm*—Werner W. Kleeman

[57] ABSTRACT

In an externally powered firing weapon the danger exists with an ignition delay or hangfire condition that the cartridge still is ignited after the positively reciprocated breechblock has been unlocked from the weapon barrel. The safety apparatus in accordance with the invention prevents, in case of an ignition delay, firing of the cartridge after unlocking of the positively reciprocated breechblock. Heretofore known safety devices of this type are complicated and a substantially simple design is strived for. The safety apparatus in accordance with the invention automatically decouples the breechblock carrier from the breechblock head when the breechblock head is locked in the weapon barrel. The device responding to an ignition delay prevents unlocking of the breechblock head from the weapon barrel and coupling of the breechblock carrier with the breechblock head. The breechblock head locked by means of a rotary lock to the weapon barrel and the breechblock carrier are preferably coupled together by means of a rotary coupling.

11 Claims, 9 Drawing Sheets

FIG. 9
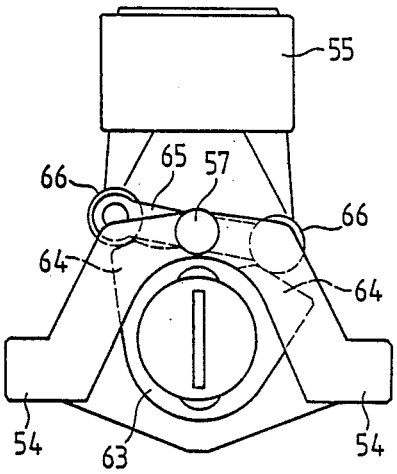
FIG. 10
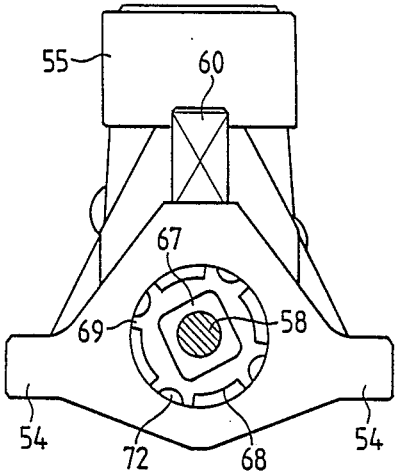
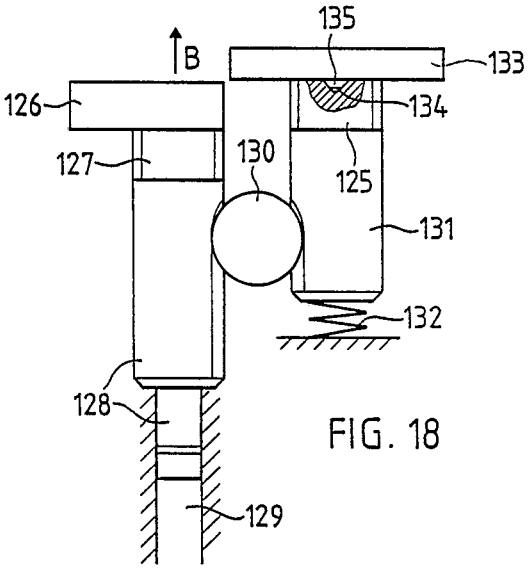
FIG. 18

SAFETY APPARATUS FOR AN EXTERNALLY POWERED FIRING WEAPON

BACKGROUND OF THE INVENTION

The present invention broadly relates to a new and improved safety apparatus for an externally powered firing weapon or firing weapon system including a weapon barrel and a positively reciprocating or to-and-fro moving breechblock which can be locked in its forwardmost or foremost position.

In its more particular aspects, the present invention relates to a new and improved safety apparatus for an externally powered firing weapon or firing weapon system comprising a weapon barrel and a positively reciprocating or to-and-fro moving breechblock which can be locked in its forwardmost or foremost position with the weapon barrel. The breechblock comprises a breechblock carrier and a breechblock head which are operatively coupled to each other. Furthermore, there is also provided a device for decoupling the breechblock carrier from the breechblock head locked to the weapon barrel, and this device responds to a hangfire condition or an ignition delay of a cartridge.

A safety apparatus of this kind is known, for example, from the commonly assigned European Published Pat. application No. 0,111,240, published June 20, 1984 and the cognate U.S. Pat. No. 4,550,641, granted Nov. 5, 1985. In this known apparatus there are provided coupling means for coupling the breechblock head to the breechblock carrier and which comprise between the breechblock head and the breechblock carrier two latches retainable by a retaining bracket. The device for decoupling the breechblock carrier from the breechblock head comprises a two-armed actuating lever which engages with an actuator mechanism mounted at the weapon housing.

This prior art safety apparatus has the shortcoming that it is relatively complicated in construction. Furthermore, the two part breechblock composed of the breechblock head and the breechblock carrier is relatively heavy and comprises a relatively large number of components. In addition, the device to decouple the breechblock carrier from the breechblock head locked to the weapon barrel is also rather complicated in construction.

SUMMARY OF THE INVENTION

Therefore, with the foregoing in mind it is a primary object of the present invention to provide a new and improved construction of a safety device for an externally powered firing weapon or firing weapon system which does not exhibit the aforementioned shortcomings of the prior art.

A first more specific object of the present invention aims at the provision of a new and improved safety apparatus for an externally powered firing weapon or firing weapon system, which is constructed in an appreciably simpler fashion than this prior construction of safety apparatus.

As an extension of the foregoing object it is a further object of the present invention to provide an improved construction of safety apparatus of simpler design, wherein, in particular, the two-part breechblock composed of the breechblock head and the breechblock carrier is designed to be appreciably lighter and to possess as few as possible parts or components.

A further noteworthy object of the present invention is directed to the provision of a new and improved construction of safety apparatus for an externally powered firing weapon or firing weapon system, wherein the device for the decoupling of the breechblock carrier from the breechblock head which is locked to the weapon barrel, is of considerably simpler construction and design and less prone to malfunction, in other words operates exceedingly reliably.

Another noteworthy object of the present invention aims at the provision of a new and improved safety apparatus for an externally powered firing weapon or firing weapon system, which safety apparatus is relatively simple in construction and design, extremely reliable in operation, not readily subject to breakdown or malfunction, and requires a minimum of maintenance and servicing.

Now in order to implement these and still further objects of the invention which will become more readily apparent as the description proceeds, the safety apparatus of the present development is manifested by the features that upon locking the breechblock head in the weapon barrel the breechblock carrier is automatically decoupled from the breechblock head, and the decoupling device responding to the ignition delay or hangfire condition prevents an unlocking of the breechblock head in the weapon barrel as well as coupling of the breechblock carrier with the breechblock head.

According to a further feature of the invention, a rotary motion lock or rotary lock is provided for locking the breechblock head to the weapon barrel and the breechblock head is coupled with the breechblock carrier by means of a rotary motion coupling or rotary coupling.

The device for decoupling the breechblock carrier from the breechblock head possesses a feeler or scanner device for determining whether or not a cartridge has been infed.

The solution proposed by the invention has the advantage that with a device to lock the breechblock head in the weapon barrel the breechblock head can be simultaneously decoupled from the breechblock carrier. In other words, the breechblock head and the breechblock carrier are decoupled when the breechblock head is locked in the weapon barrel.

A further advantage of the safety apparatus according to the ivention when compared with the known is that the decoupling device and the cartridge feeler or scanner device to determine whether a cartridge is present or not are located at a stationary housing and not at the breechblock.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 9 is a rear view of the breechblock illustrated in FIG. 7;

FIG. 10 is a view looking in the direction of the arrow X in FIG. 12;

FIG. 18 is a view looking in the direction of the arrow XVIII in FIG. 15; and

DETAILED DESCRIPTION OF THE PREFERRED EMBODIMENTS

Describing now the drawings, it is to be understood that only enough of the construction of the externally powered firing weapon or firing weapon system including the safety apparatus according to the invention have been shown as needed for those skilled in the art to readily understand the underlying principles and concepts of the present development, while simplifying the showing of the drawings.

Figure 1:
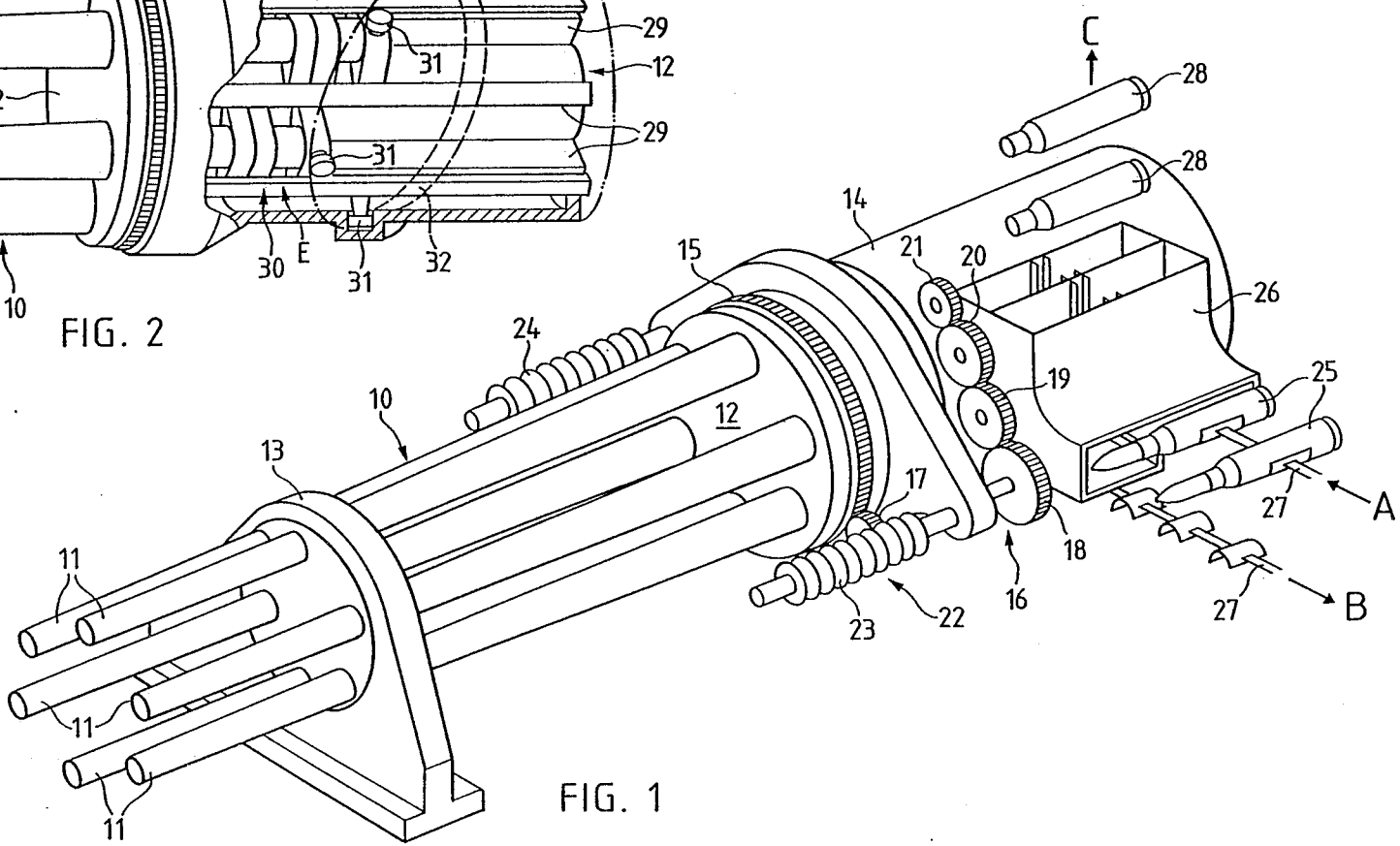
FIG. 1 is a perspective view of a multi barrel firing weapon or firing weapon system in the nature of a Gatling gun.

Turning attention now to FIG. 1, there has been illustrated in perspective view therein a Gatling gun comprising a weapon barrel cluster 10 of, for instance, six weapon barrels 11 which are mounted at their rear ends at a rotor 12. The weapon barrel cluster 10 is rotatably mounted at the region of its front end or end region in a support or support structure 13. The rotor 12 is also rotatably mounted at a weapon housing 14. A gear rim 15 is secured to the rotor 12 and operatively engages with a gearing system or gear train 16. Five gears 17 to 21 of this gearing system or gear train 16 are visible in the perspective view of FIG. 1. The rotor 12 including the weapon barrel cluster 10 is driven via the gearing system or gear train 16 by means of any suitable electric motor which is not here shown. The weapon housing 14 is mounted at a recoil arrangement here essentially composed of two plate spring packages or sets 23 and 24. An ammunition infeed or feed housing 26 is mounted at the weapon housing 14 for loading or infeeding cartridges 25. The cartridges 25 are delivered to the ammunition infeed or feed housing 26 by an endless belt conveyor 27 in the direction of the arrow A. The empty belt conveyor 27 moves in the direction of the arrow B to a not particularly shown ammunition container. The empty cartridge cases 28 are ejected from the ammunition feed housing 26 in the direction of the arrow C.

Figure 2:
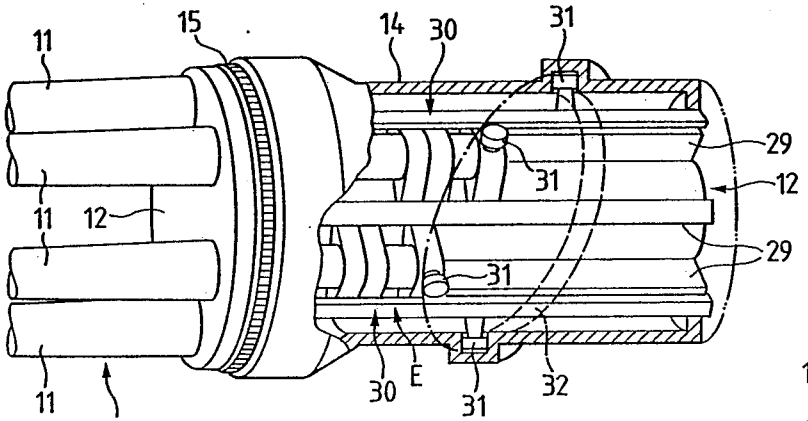
FIG. 2 is a perspective view of the rotor of the firing weapon or firing weapon system shown in FIG. 1 including a sectional view of the weapon housing.

As shown in FIG. 2 of the drawings, the rotor 12 which is rotatably mounted in the weapon housing 14 comprises guide rails 29. A respective breechblock 30 is displaceably supported between each two such guide rails 29. At each breechblock 30 there is mounted a cam follower roll 31 which engages with a control cam 32 for the breechblock 30. This control cam 32 for the breechblocks 30 is located within the weapon housing 14 and causes each breechblock 30 to be reciprocated or moved back-and-forth once during each complete rotation of the rotor 12 within the weapon housing 14. In a manner known in this art a cartridge 25 is rammed or pushed into the weapon barrel 11 when the related breechblock 30 is forwardly displaced. The empty cartridge case 28 is extracted from the weapon barrel 11 and ejected during the return movement or retraction of the related breechblock 30. Each breechblock 30 is locked in the foremost or forwardmost position thereof prior to firing the cartridge or round. The breechblock 30 is again unlocked as soon as the cartridge or round is fired. Since, as stated hereinbefore, the rotor 12 is driven by a suitable electric motor, the advance motion of the breechblock 30, the locking and unlocking thereof and the return motion thereof are positively effected.

An ignition delay or a hangfire condition can occur in the event that the cartridge 25 is not ignited or fired within the proper time. In such case it could happen that the breechblock 30 is already again unlocked prior to the actual firing of the round.

The safety or anti-hangfire apparatus according to the invention prevents, in the case of delayed ignition of the cartridges or rounds, that the breechblock 30 will be prematurely unlocked. This safety apparatus will be described hereinbelow.

Figure 3:
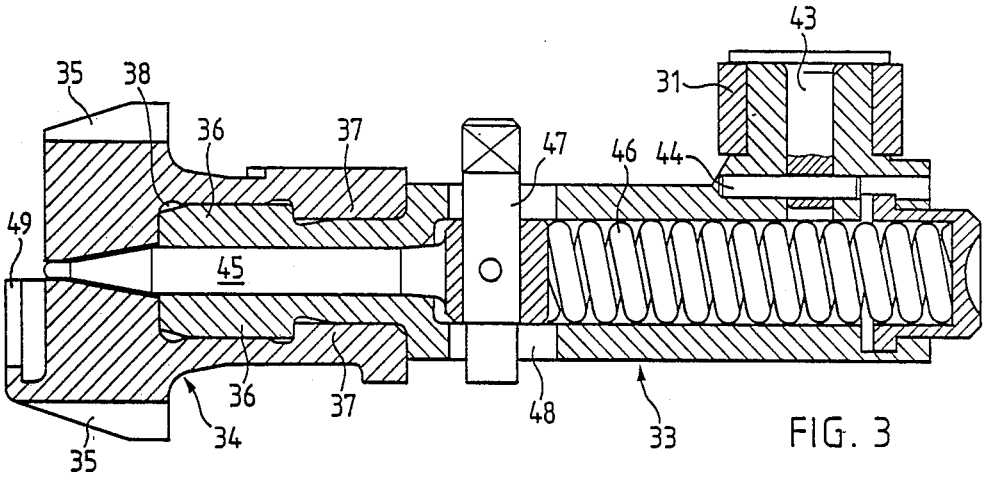
FIG. 3 is a vertical section of a first exemplary embodiment of a weapon breechblock.

As shown in FIG. 3, the breechblock 30 of a first exemplary embodiment of the invention comprises a breechblock carrier 33 and a breechblock head 34 which are operatively coupled to each other but can be decoupled or separated from each other. This separation or decoupling of the breechblock head 34 and the breechblock carrier 33 from one another, however, occurs solely in the aforementioned ignition delay or hangfire condition.

Figure 6:
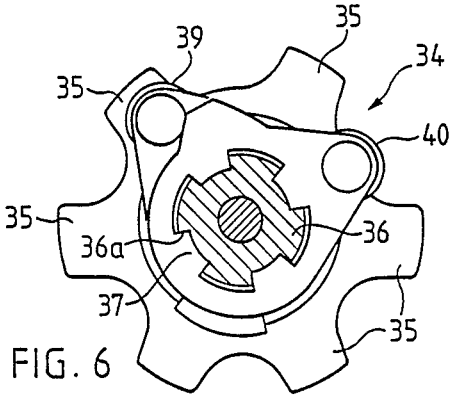
FIG. 6 is a sectional view taken substantially along the line VI—VI in FIG. 4.

The breechblock head 34 comprises, as shown in FIG. 6, a number of locking cams or dogs 35 or equivalent structure, for example six, by means of which the breechblock 30 can be locked in the weapon barrel 11 by rotation in conventional manner. The breechblock carrier 33 displaceably supported in the guide rails 29 is not rotatable. To couple or lock the breechblock head 34 to the breechblock carrier 33, a bayonet type lock is provided. As shown in FIG. 6, this bayonet type lock is composed of, for example, four outer cams or dogs 36 or the like at the front end of the breechblock carrier 33 and correspondingly four inner cams or dogs 37 or the like at the rear end of the breechblock head 34. In the position of the breechblock head 34 as shown in FIG. 6 of the drawings, the inner cams 37 are located precisely in the gaps or spaces **36*a* between the outer cams 36 of the breechblock carrier 33, thus allowing the front end of the breechblock carrier 33 to be withdrawn or extracted from the breechblock head 34. In this position, the breechblock head 34 is firmly locked or coupled by means of the cams 35 to the weapon barrel 11 in a known manner which is not here particularly shown. As soon as the breechblock carrier 33 is totally pushed into the breechblock head 34, the outer cams or dogs 36 of the breechblock carrier 33 extend so far into a cylindrical cavity or space 38 (FIG. 3) of the breechblock head 34 that the breechblock head 34 can be rotated relative to the breechblock carrier 33 into either the locked or coupled or the unlocked or decoupled position thereof. Simultaneously, the breechblock head 34 can be rotated relative to the weapon barrel 11 into either its locked or coupled or unlocked or uncoupled position. The locking cams 35, the inner cams 37 and the outer cams 36 are mutually matched and structured with respect to one another so as to allow the breechblock head 34 to be locked either to the weapon barrel 11 or coupled with the breechblock carrier 33**.

Figure 4:
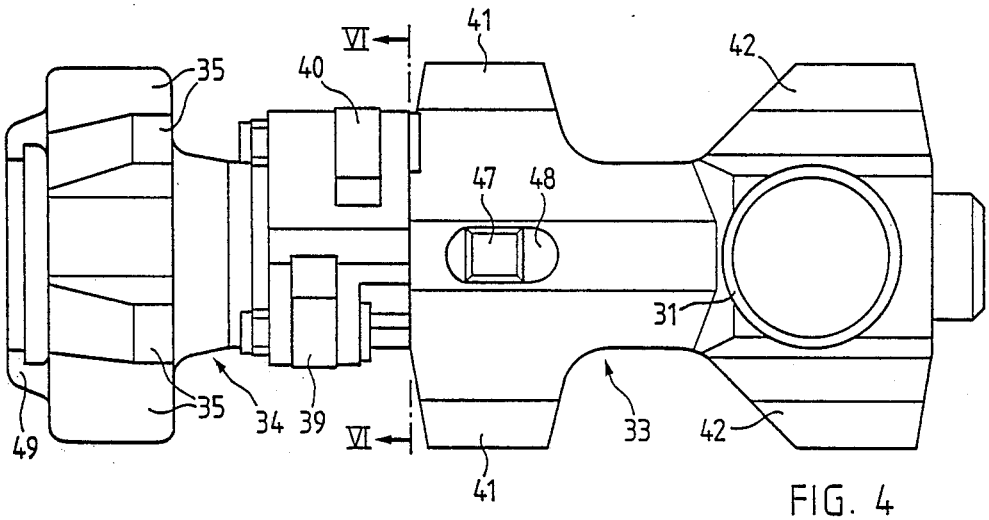
FIG. 4 is a top plan view of the breechblock illustrated in FIG. 3.
Figure 5:
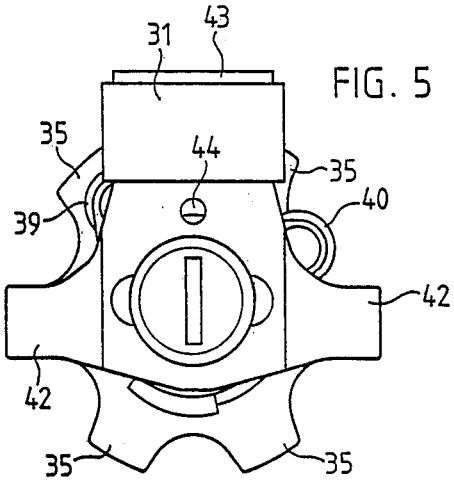
FIG. 5 is a rear view of the breechblock illustrated in FIG. 3.

Two rolls or roller members 39 and 40 hingedly coupled or connected to the breechblock head 34 enable rotation of the breechblock head 34 in the clockwise or counterclockwise direction. These rolls 39 and 40 cooperate with control cams which are described further below and have been particularly shown in FIGS. 13 and 14 of the drawings. As will be recognized from FIGS. 4 and 5 of the drawings, the breechblock carrier 33 is provided with four guide cams or dogs 41 and 42 or equivalent structure by means of which it is displaceably guided in the guide tracks or guide rails 29 of the weapon housing 14 (FIG. 2). The cam follower roll or roller 31 already mentioned hereinbefore engages with the control cam 32 (FIG. 2) and serves to displace the breechblock 30 within the weapon housing 14. By means of a bolt 43 and a pin 44, this cam follower roll 31 is fastened at the related breechblock carrier 33, but is readily replaceable. Within the breechblock carrier 33, an ignition or firing pin 45, as particularly well shown in FIG. 3, is displaceably mounted. The tapered tip of this ignition or firing pin 45 penetrates or extends through the breechblock head 34. A powerful spring 46 tends to thrust the ignition or firing pin 45 into its forwardmost or foremost position shown in FIG. 3.

At the rear end of the ignition or firing pin 45 there is fastened or mounted an entrainment or entraining member 47 which extends through an elongate or oblong hole 48 of the breechblock carrier 33. By the cooperation of a not particularly shown cam plate, the ignition or firing pin 45 is retracted by means of the entrainment or entraining member 47 against the action of the spring 46 and then released at the desired instant in order to penetrate into the cartridge 25. !1 At the front end of the breechblock head 34 there is arranged an extractor hook or claw 49 which in known manner serves to extract the empty cartridge cases 28 from the cartridge chamber of the weapon barrel 11.

Figure 7:
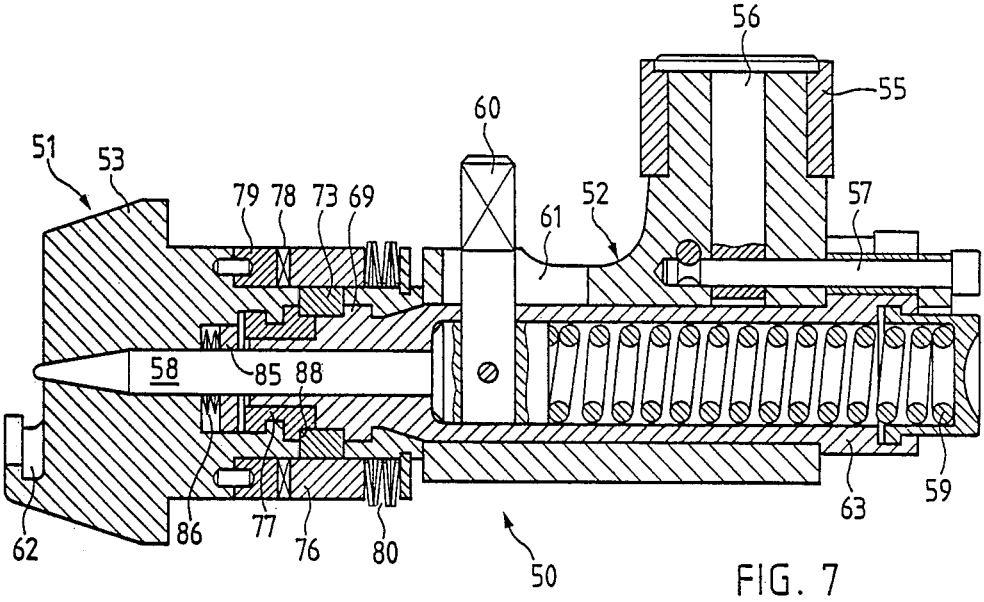
FIG. 7 is a vertical section of a second exemplary embodiment of the weapon breechblock.
Figure 8:
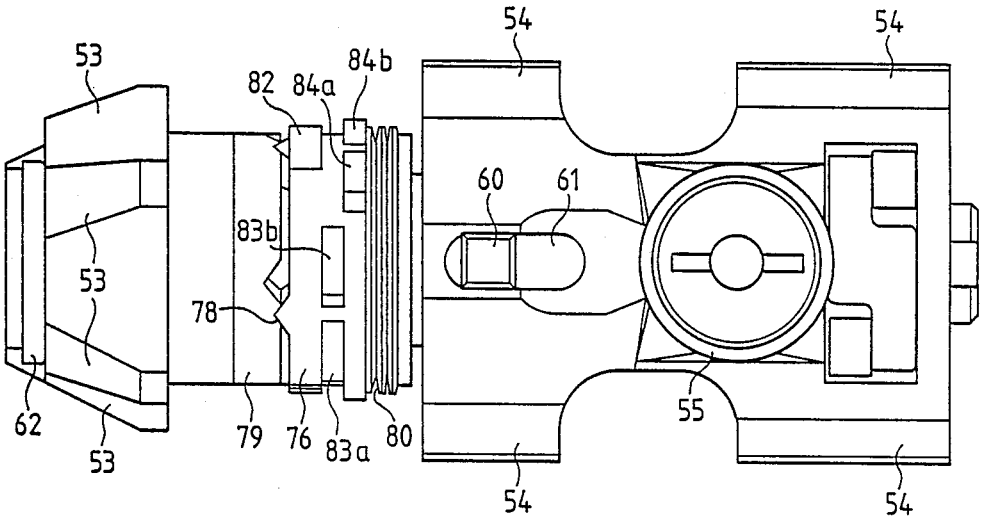
FIG. 8 is a top plan view of the breechblock illustrated in FIG. 7.
Figure 12:
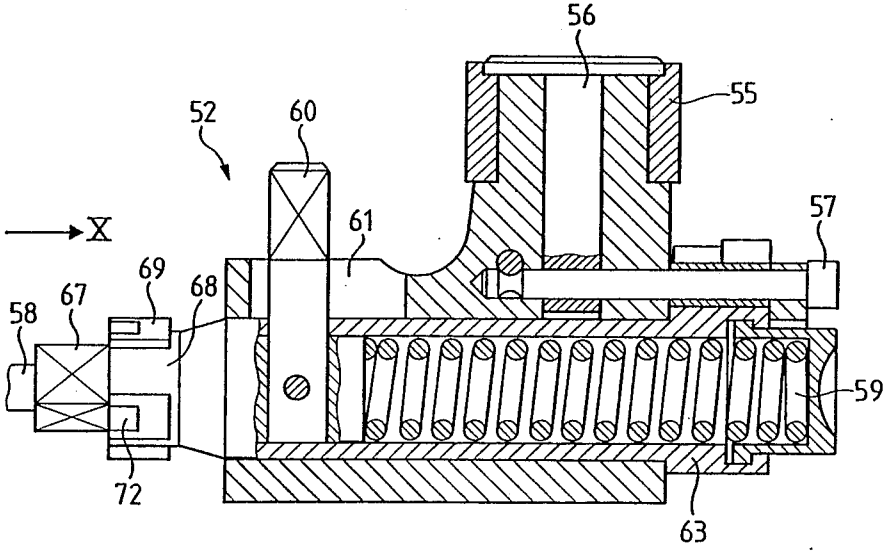
FIG. 12 is a sectional view of the breechblock carrier of the breechblock illustrated in FIG. 7.
Figure 11:
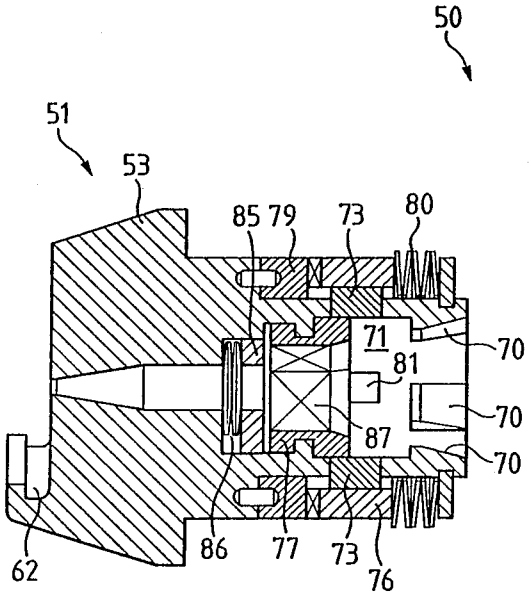
FIG. 11 is a sectional view of the breechblock head of the breechblock illustrated in FIG. 7.

In accordance with FIGS. 7 to 12, the breechblock 50 of a second exemplary embodiment of the safety or anti-hangfire apparatus according to the present invention comprises a breechblock head 51 and a breechblock carrier 52 which, as shown in FIGS. 11 and 12, can be decoupled or unlocked from each other. Also in this case, the separation of the breechblock head 51 from the breechblock carrier 52 occurs only in the ignition delay or hangfire condition. As shown in FIG. 8, the breechblock head 51 is provided with a plurality of locking cams or dogs 53, for instance six, just like in the case of the first exemplary embodiment of the safety or anti-hangfire apparatus shown in FIG. 6. By means of these locking cams 53, the breechblock 50 can be locked in known manner in the weapon barrel 11 by rotating the breechblock head 51. The breechblock carrier 52 mounted in the guide tracks or guide rails 29 is not rotatable. This breechblock carrier 52 comprises four guide cams or dogs 54 as shown in FIGS. 8, 9 and 10 by means of which it is displaceably guided in the guide tracks or guide rails 29 of the weapon housing 14 shown in FIG. 2. A cam follower roll or roller member 55 extending into the control cam 32, shown in FIG. 2, serves to reciprocatingly displace the breechblock 50 within the weapon housing 14. By means of a bolt 56 and a pin 57, this cam follower roll 55 is fastened at the breechblock carrier 52, but is readily replaceable.

As described hereinbefore in connection with the first exemplary embodiment, an ignition or firing pin 58 is provided within the breechblock carrier 52 as clearly shown in FIG. 7. The tapered tip of the ignition or firing pin 58 penetrates or extends through the breechblock head 51. A powerful spring 59 tends to thrust the ignition or firing pin 58 into its forwardmost or foremost position as will be evident from FIG. 7. At the rear end of the ignition or firing pin 58 there is mounted an entrainment or entraining member 60 which extends through an elongate or oblong hole 61 of the breechblock carrier 52. This ignition or firing pin 58, through the cooperation of a not particularly shown cam plate, also can be retracted by means of the entrainment or entraining member 60 against the force of the spring 59 and then released at the desired instant in order to pierce or penetrate a cartridge 25. At the front end of the breechblock head 51 there is provided an extractor hook or claw 62 which in known manner serves to extract the empty cartridge cases 28 from the cartridge chamber of the related weapon barrel 11.

The parts of the breechblock 50 heretofore described are similarly constructed for both exemplary embodiments illustrated in FIGS. 3 to 6 and in FIGS. 7 to 12, respectively. However, a substantial design difference is seen in the coupling between the breechblock head 51 and the breechblock carrier 52. This difference will be described hereinbelow.

Figure 19:
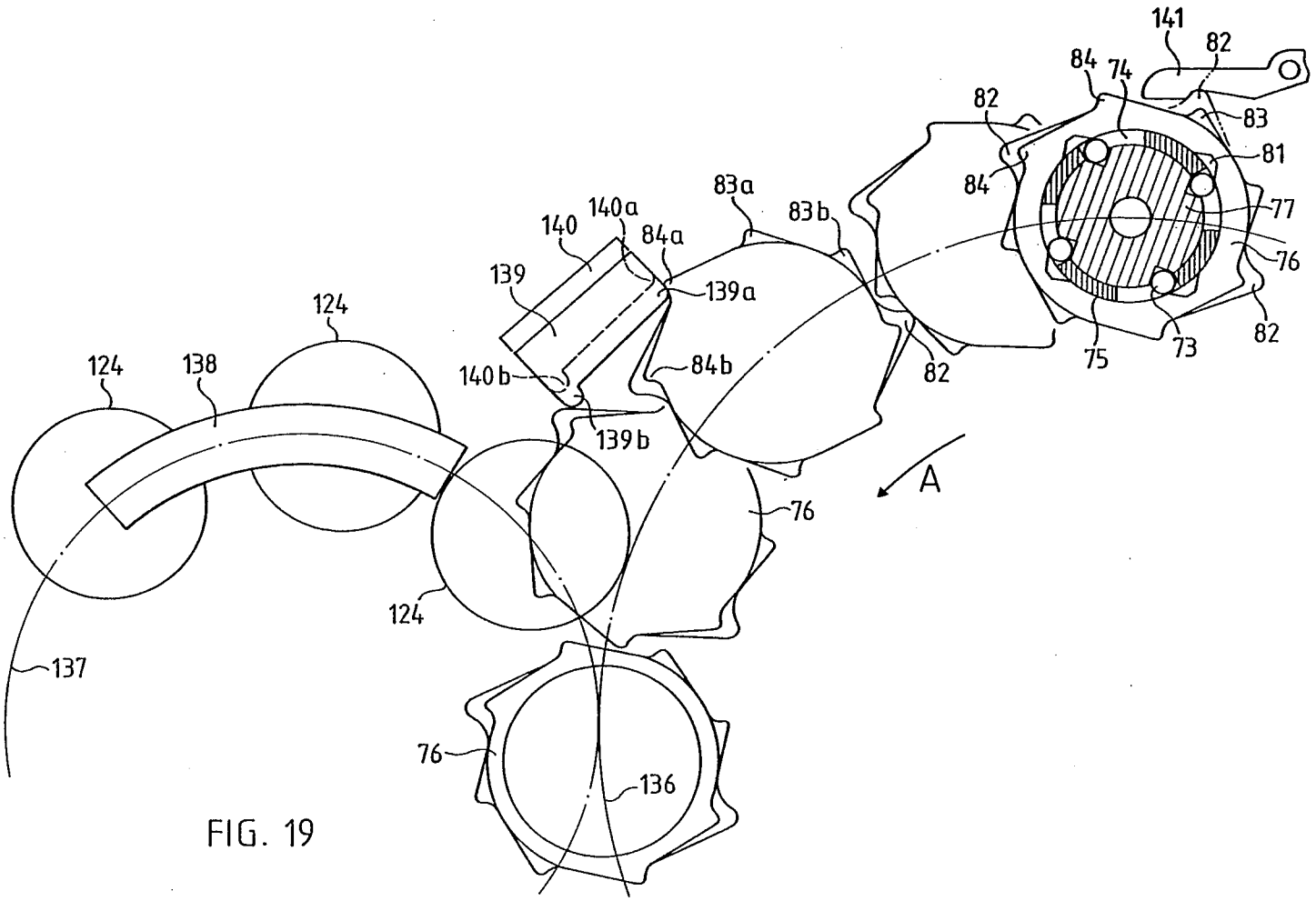
FIG. 19 illustrates a locking and unlocking device for the breechblock according to FIGS. 7 to 12.

Within the breechblock carrier 52 there is arranged a sleeve or sleeve member 63 which is rotatably mounted but not axially displaceable. As shown in FIG. 9, this sleeve 63 is provided with two cams or dogs 64 or the like at its rear end. Above these cams 64 there is arranged a lever or lever member 65 which is pivotably mounted around the pin 57 mentioned hereinbefore and bearing at each of its ends a roll or roller member 66. These two rolls 66 cooperate with a not particularly shown cam plate to allow rotation of the breechblock head 51 via the sleeve 63 in the clockwise or counterclockwise direction, such that the breechblock head 51 can be locked or unlocked in the weapon barrel 11. At the front end of the sleeve 63 there is provided, as shown in FIGS. 10 and 12, a square stubshaft 67 or the like located directly behind the ignition or firing pin 58. A cylindrical part or portion 68 located behind this square stubshaft 67 is provided with, for example, four outer cams or dogs 69 uniformly arranged along the circumference of the cylindrical part 68. Correspondingly, the breechblock head 51 is provided with four inner cams or dogs 70 or the like at its rear end. These outer cams 69 together with the inner cams 70 form a bayonet-like lock as described hereinbefore in connection with the first embodiment illustrated in FIG. 3. As soon as the breechblock carrier 52 is completely pushed into the breechblock head 51 (FIG. 7), the outer cams 69 of the sleeve 63 extend into a cylindrical cavity or space 71 in such a manner that the sleeve 63 can be rotated relative to the breechblock head 51 until the breechblock head 51 is in its unlocked or locked position. However, the moment the breechblock head 51 and the breechblock carrier 52 are coupled together via the sleeve 63 and the bayonet type lock described hereinbefore, it is necessary that they are furthermore connected together by means of a rotary motion lock or rotary lock to allow the breechblock head 51 to be locked in the related weapon barrel 11. The design and mode of operation of this rotary motion lock or rotary lock are described hereinbelow:

To disengageably transmit the torque from the sleeve 63 mounted at the breechblock carrier 52 to the breechblock head 51 there are provided segmentally shaped cut-outs or recesses 72 in the outer cams 69 as shown in FIGS. 10 and 12. Each of these cut-outs or recesses 72 serves to receive a roll or roller member 73 or equivalent structure. These rolls 73, which define locking elements or bodies, are located in rectangular pockets or cut-outs 74 provided within the housing 75 of the breechblock head 51 as illustrated in FIG. 19. To avoid that these rolls 73 fall out of the pockets or cut-outs 74 in the housing 75, there is provided, on the one hand, an outer actuating or switching ring 76 and, on the other hand, an inner retaining or holder ring 77 rotatably mounted at the housing 75. The outer actuating ring 76 is provided with a face gear or face serrations 78 which engage with a corresponding counter gear or tooth system provided, at a ring or ring member 79 which is rigidly mounted at the housing 75. A plate spring assembly or package 80 tends to press the actuating ring 76 against the rigidly mounted ring 79 (FIG. 8).

The actuating ring 76 possesses four segmentally shaped cut-outs or recesses 81 (FIG. 19) uniformly arranged at the inner side thereof and three rows of outer cams or dogs 82, 83 and 84 (FIGS. 8 and 19). The function of these outer cams 82, 83 and 84 ill be described hereinbelow. The retaining or holder ring 77 is also provided with a face gear or face serrations which engage with a corresponding counter gear or tooth system provided at a locking or securing ring 85. This locking or securing ring 85 is pressed against the retaining or holder ring 77 by means of a plate spring assembly or package 86, thus preventing any unintentional rotation of the retaining or holder ring 77. This retaining or holder ring 77 possesses a square axial bore 87 (FIG. 11) which can engage with the already described outer square stubshaft 67 described hereinbefore. The face serrations 78 of the actuating ring 76 as well as the face serrations at the retaining ring 77 are structured to allow the actuating ring 76 and the retaining ring 77 to rotate against the force of the plate spring assemblies or packages 80 and 86 although these springs secure both rings 76 and 77 against unintentional rotation.

As shown in FIG. 7, the rolls 73 protrude into the cut-outs or recesses 72 (FIG. 10) of the outer cams 69 and are not located in the cut-outs 81 (FIG. 19) of the actuating ring 76. Simultaneously, the rolls 73 protrude into corresponding cut-outs or recesses 88 provided at the outer circumference of the retaining ring 77. On the other hand, as shown in FIG. 11, the rolls 73 extend into the segmentally shaped cut-outs or recesses 81 of the retaining ring 76 and not into the cut-outs or recesses 72 of the outer cams 69. The retaining ring 77 serves to prevent the rolls 73 from falling out the moment the breechblock head 51 is decoupled from the breechblock carrier 52 (FIGS. 11 and 12).

Figure 13:
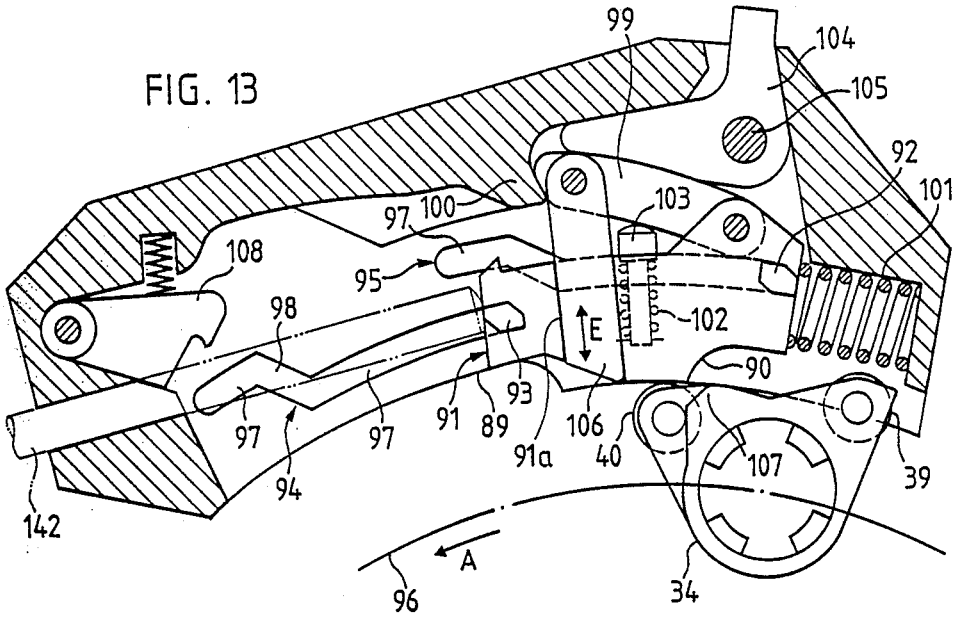
FIG. 13 illustrates a locking and unlocking device for the breechblock shown in FIGS. 3 to 6.
Figure 14:
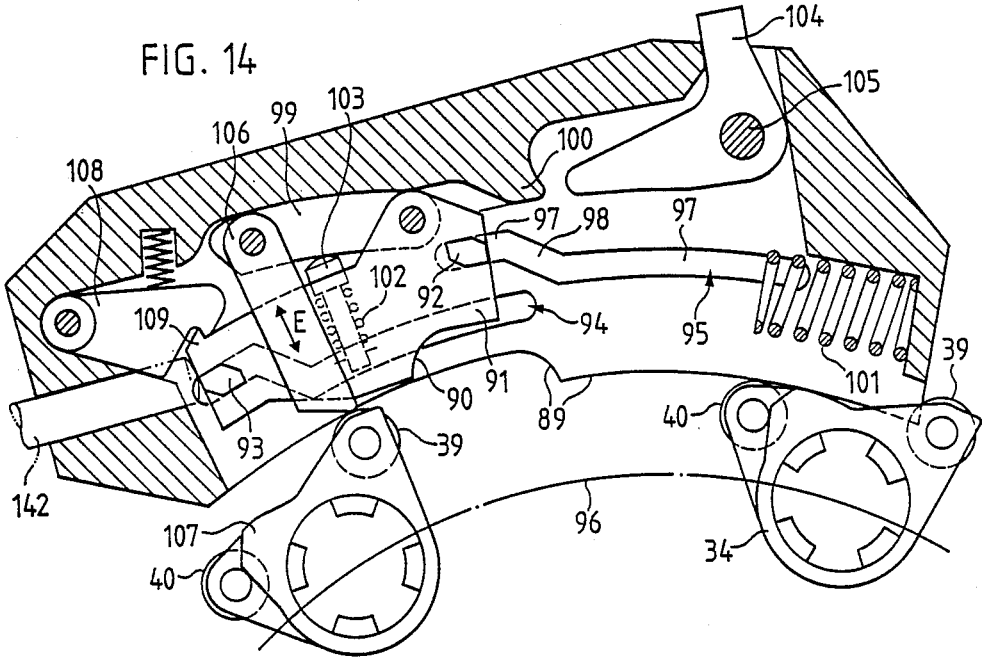
FIG. 14 is the same device as shown in FIG. 13 but depicted in another position.

The device illustrated in FIGS. 13 and 14 serves to lock and unlock the breechblock head 34 in the related weapon barrel 11 in accordance with the first embodiment of the breechblock 30 as shown in FIGS. 3 to 6. As hereinbefore described, the breechblock head 34 possesses the rear roll or roller member 40 which engages with a first control cam 89 in order to lock the breechblock head 34 in the weapon barrel 11. Furthermore, the breechblock head 34 possesses the front roll or roller member 39 which cooperates with a second displaceable control cam 90 in order to unlock the breechblock head 34 from the weapon barrel 11. Since the locking of the breechblock head 34 in the weapon barrel 11 must take place each and every time, the first control cam 89 can be stationary and rigidly mounted. On the other hand, since the unlocking operation may only then take place when there is no ignition delay or hangfire condition, the second control cam 90 must be displaceably mounted. For this reason, the second control cam 90 is located on a displaceable plate or plate member 91 which can be moved in radial and tangential direction relative to the breechblock 30 from the operative or effectual position shown in FIG. 13 into the inoperative or ineffectual position shown in FIG. 14. For this displacement, the plate 91 is provided with two cams or dogs 92 and 93 each of which is guided in a separate guide groove or slot 94 and 95, respectively. These guide grooves or slots 94, 95 each consist of two curved sections 97 which are arranged in concentric relation with respect to the path of motion 96 of the breechblock 30 and one linear or straight section 98 which connects the two curved sections 97 with each other at each such groove or slot. A pivotable or swinging lever or lever member 99 is pivotably mounted at the cam plate 91. In the operative position of the plate 91, the lever 99 abuts against a stationary lug or nose 100 thus preventing a displacement of the plate 91. A spring 101 or the like tends to push the plate 91 out of its operative position shown in FIG. 13 into its inoperative position shown in FIG. 14. Another spring 102 tends via a plunger or ram plug 103 to pivot the lever 99 in the clockwise direction.

To pivot the lever 99 in the counterclockwise direction there is provided an angle lever 104 which is rotatably mounted about an axis or pivot shaft 105. This angle lever 104 can, in case of an ignition delay or hangfire condition, be pivoted from the position shown in FIG. 13 into the position shown in FIG. 14 as will be more fully explained hereinafter, such that the lever 99 is also pivoted against the force of the spring 102 and thus disengaged from the lug or nose 100. Now, the spring 101 is in a position to move the plate 91 out of the position shown in FIG. 13 to the left into the position shown in FIG. 14. A pawl 106 or the like is mounted at the lever 99 and is displaceable but not pivotable in the guide groove 91*a* of the plate 91 in the direction of the double-headed arrow E. The moment the angle lever 104 forces the lever 99 to disengage from the lug or nose 100, the pawl 106 engages with a cam 107 (FIG. 14) of the breechblock head 34. This cam 107 is thus able to push the plate 91 completely into the position shown in FIG. 14, whereby the pawl 106 disengages from the cam 107 as soon as the spring 102 pivots away the lever 99 via the plunger or ram plug 103, thus also pushing the pawl 106 away from engagement with the cam 107. A further pawl 108 serves to latchingly retain the plate 91 in the end or terminal position thereof as illustrated in FIG. 14. This pawl 108 can be held in a snap-in or latched position by a hook 109 provided at the plate 91. A pin 142 serves to release this pawl 108 from the hook 109 and to return the plate 91 to its initial or starting position as shown in FIG. 13.

The angle lever 104 shown in FIGS. 13 and 14 must only be actuated in case of an ignition delay or hangfire condition when a cartridge is not ignited or fired within the proper time. When ignition is not delayed and the cartridge is ignited in time, then the actuation of the angle lever 104 is prevented by actuation of a gas piston as will be explained hereinafter. In the event a cartridge is not infed, the gas piston cannot be actuated and nonetheless actuation of the angle lever 104 must be prevented since no hangfire condition prevails. Therefore, before a round is fired, it is essential to check every time whether a cartridge is present or not, because the angle lever 104 is only to be actuated when a cartridge has been correctly inserted and if thereafter the gas piston was not actuated in time.

Figure 15:
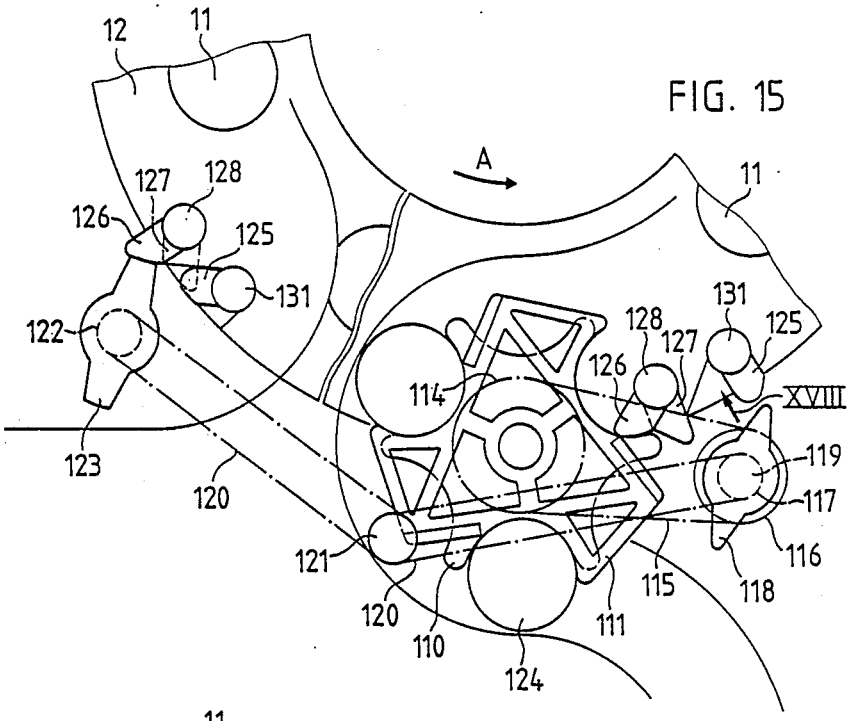
FIG. 15 illustrates schematically a cartridge feeler or scanner device in a position when a cartridge is present.
Figure 16:
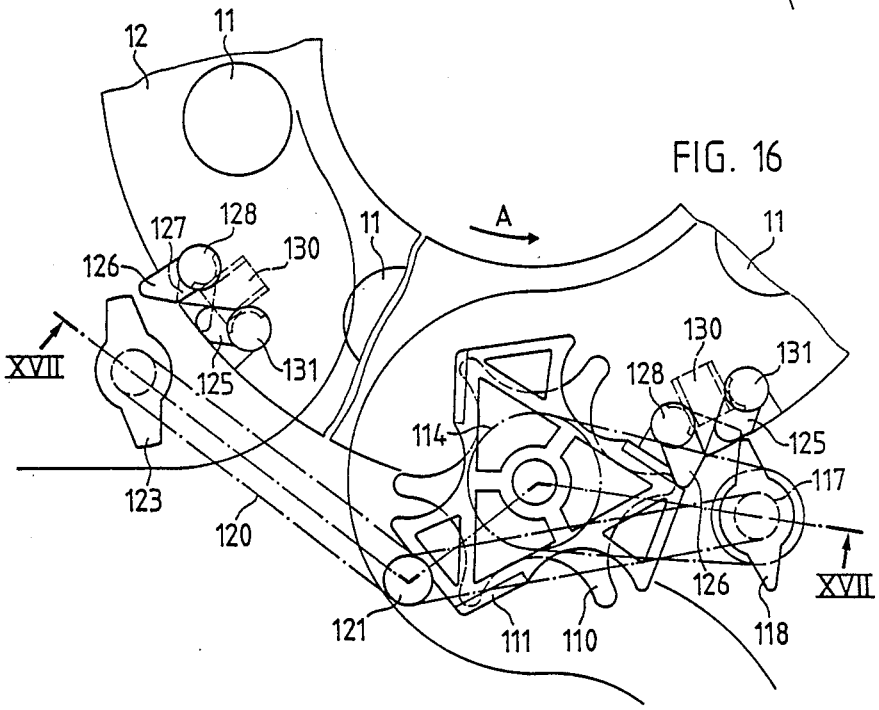
FIG. 16 shows the same cartridge feeler or scanner device as in FIG. 15 but in a position when the cartridge is missing.
Figure 17:
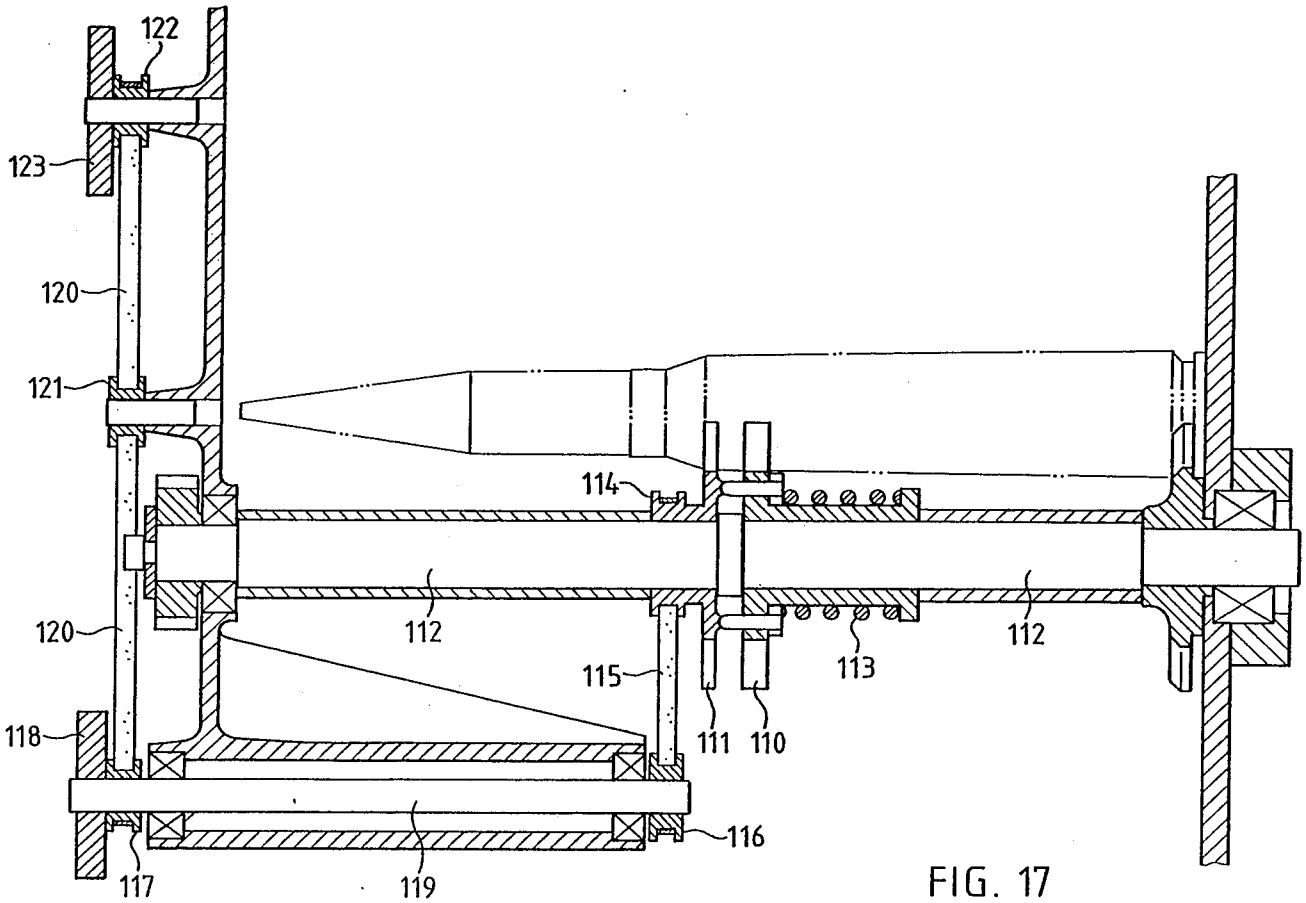
FIG. 17 is a longitudinal section of the device illustrated in FIGS. 15 and 16 taken substantially along the line XVII—XVII in FIG. 16.

The device for determining whether or not a cartridge has been inserted is illustrated in FIGS. 15 to 18. This device comprises two star wheels 110 and 111 one of which wheels is designated as the transfer wheel 110 while the other wheel is designated as the sensing or feeler wheel 111. As shown in FIG. 17, the transfer wheel 110 is rigidly mounted at a shaft 112 while the sensing wheel 111 is rotatably mounted at the same shaft 112 and can be rotated through an angle of, for example, less then 30°.

A return or resetting spring 113 engaging, on the one hand, with the transfer wheel 110 and, on the other hand, with the sensing or feeler wheel 111 tends to rotate both star wheels 110 and 111 into the position shown in FIG. 16, such that the teeth of the one star wheel extend into or overlie the tooth gaps or spaces of the other star wheel and vice versa. A first belt pulley 114 is rigidly connected with the sensing or feeler wheel 111 and drives a second belt pulley 116 by means of a first toothed belt 115 defining a power transmitting element. This second belt pulley 116 is mounted on a shaft 119 together with a third belt pulley 117 and a cam wheel 118. The third belt pulley 117 drives by means of a second toothed belt 120 defining a power transmitting element and via a deflection pulley 121 a fourth belt pulley 122. A second cam wheel 123 is rigidly connected to this fourth belt pulley 122. In the presence of an inserted cartridge 124, the sensing wheel 111 is rotated relative to the transfer wheel 110, such that the gaps of both star wheels 110 and 111 coincide or overlie one another as shown in FIG. 15. As will be recognized from FIGS. 15 and 16, the transfer wheel 110 is in the same position in both FIGS. 15 and 16, but the sensing wheel 111 is in different positions depending on whether the cartridge 124 is present as in FIG. 15 or missing as in FIG. 16. Correspondingly, both cam wheels 118 and 123 are shown in FIG. 15 in a position different from that shown in FIG. 16, although as hereinbefore mentioned the transfer wheel 110 is in the same position in both FIGS. 15 and 16. It is thus evident that in the presence of a cartridge 124 the sensing wheel 111 occupies a position different to that when the cartridge is missing or absent and correspondingly, the two cam wheels 118 and 123 actuated via the belt pulleys 114, 116, 117 and 122 and the toothed belts 115 and 120 also occupy a position different from that which they occupy when the cartridge is missing. In this connection it must be understood that during the supply of cartridges 124, the transfer wheel 110 as well as the sensing wheel 111 and therefore also the cam wheels 118 and 123 are continuously in rotary motion, but in one special position of the transfer wheel 110, which as mentioned hereinbefore is the same in both FIGS. 15 and 16, both cam wheels 118 and 123 occupy a different position when a cartridge is present as shown in FIG. 15 than the position they occupy when the cartridge is missing as shown in FIG. 16.

The components or parts described so far, in particular the two star wheels 110 and 111 as well as the cam wheels 118 and 123, are located in the stationary weapons housing 14 or in the ammunition feed housing 26 shown in FIG. 1 at which the rotor 12 is rotatably mounted. In the rotor 12 there are arranged the six weapon barrels 11 of which only three are shown in FIGS. 15 and 16. Each of these weapon barrels 11 is provided with three pivotable cams or dogs 125, 126 and 127, but in the FIGS. 15 and 16 only two sets of these three cams 125, 126 and 127 are visible. These cams 125, 126 and 127 move relative to the cam wheels 118 and 123 when the rotor 12 rotates in the direction of the arrow A. As shown in FIG. 15 for the case that the cartridge 124 is present, the cam wheel 123 is now in a position to actuate the cam 126. As shown in FIG. 16 with no cartridge 124 present, the cam wheel 123 is not in a position to actuate the cam 126. However, as shown in FIG. 15 with the cartridge 124 present, the cam wheel 118 cannot actuate the cam 125, and as shown in FIG. 16 with no cartridge 124 present, the cam wheel 118 can actuate the cam 125. Consequently, the position of these three cams 125, 126 and 127 is dependent on whether or not a cartridge 124 is present.

As can be seen in FIG. 18, the cams 126 and 127 are mounted on a gas piston or gas actuated piston 128 which is displaceable in a gas cylinder 129 but also rotatable about its longitudinal axis, so that the cams 126 and 127 are pivoted from the operative position into the inoperative position. Rotation of the piston 128 is transmitted via a gear rack 130 to a second piston 131 which rotates in the opposite sense of rotation. The piston 131 is pressed against a lock-in plate 133 or the like by means of a spring 132. The second piston 131 is provided with cut-outs or recesses 134 engaging with a cam 135 of the lock-in plate 133 in order to prevent an unintentional rotation of the second piston 131. For better understanding, reference is made to the following details: the cam 125 can only be actuated by the cam wheel 118, the cam 126 can only be actuated by the cam wheel 123 and the cam 127 serves solely to actuate the angle lever 104 shown in FIGS. 13 and 14, provided that the gas pressure on the gas piston or gas actuated piston 128 does not axially displace this cam 127 out of the range of the angle lever 104.

The device to control the second exemplary embodiment of the breechblock 50 illustrated in FIGS. 7 and 8 of the drawings is described hereinbelow with reference to FIG. 19. Each breechblock 50 mounted at the rotor 12 moves along a circular path 136 when the rotor 12 shown in FIGS. 1 and 2 is in rotation. In FIG. 19 of the drawings only the outer actuating ring 76 of the breechblock 50 is shown along the circular path 136. Adjacent the rotor 12 there is mounted a transfer wheel which in FIG. 19 is conveniently schematically represented in the form of a circle 137. The cartridges 124 are conveyed by means of this transfer wheel 137. In FIG. 19 of the drawings only three cartridges 124 are shown in outline. The infeed or feed of the cartridges 124 actuates a sensing or feeler lever 138. This sensing or feeler lever 138 is appropriately connected to two control cams 139 and 140 by a suitable linkage not particularly shown in the drawings to preserve clarity of drawing illustration. As shown in FIG. 19, the control cam 139 is in its operative or effectual position while the control cam 140 is in its inoperative or ineffectual position. These two control cams 139 and 140 are connected to each other, such that always only one of the two cams can attain the operative position while the other cam is in the inoperative position. The control cam 139 assumes its operative position shown in FIG. 19 as soon as the sensing or feeler lever 138 is actuated by a cartridge 124. The control cam 139 is located in the range of the two cams 84*a* and 84*b* of the actuating ring 76 and the control cam 140 is located in the range of the two cams 83*a* and 83*b* of the actuating ring 76. The control cam 139 is provided with a first control edge 139*a* to actuate the cam 84*a* and a second control edge 139*b* to actuate the cam 84*b*. In the same manner and as shown in FIG. 19, the control cam 140 is provided with a first control edge 140*a* and a second control edge 140*b* to actuate the first cam 83*a* and the second cam 83*b*, respectively, also shown in FIG. 8.

A third pivotable control cam or lever 141 is shown in FIG. 19 in its operative position. This third control cam or lever 141 can be pivoted out of its operative or effectual position by means of the gas pressure when a round is fired. The pivotable control cam or lever 141 is located within the range of the cam 82 of the actuating ring 76. In the event of a delayed ignition or hangfire condition, this control cam or lever 141 is able to rotate the actuating ring 76 via the cam 82 to such an extent that the breechblock head 51 and the breechblock carrier 52 can be separated or decoupled from each other (see FIGS. 7, 11 and 12 of the drawings) and the breechblock head 51 remains locked in the related weapon barrel 11 during the reverse or rearward movement of the breechblock carrier 52.

The mode of operation of the first embodiment of the safety device as described hereinbefore will now be considered and is as follows:

In accordance with FIGS. 1 and 2 the cartridges 25 are supplied to the ammunition infeed or feed housing 26 of the ammunition supply device in the direction of the arrow A. The cartridges 25 are then conveyed into the weapon housing 14 by means of the star wheel 110 shown in FIG. 15. Within this weapon housing 14 each cartridge 25 is engaged by a related breechblock 30 and pushed into the related or corresponding weapon barrel 11. During this operation, the rotor 12 rotates in the direction of the arrow A as shown in FIGS. 15 and 16. At the position E as shown in FIG. 2, the breechblock 30 has reached its forwardmost or foremost position with the assistance of the breechblock control cam 32 (FIG. 2) and the cam follower roll 31. In this forwardmost position the cartridge 25 is penetrated by the ignition or firing pin 45 (FIG. 3). In the case that the propellant charge in the cartridge 25 is ignited in time, then the propellant gas enters the gas intake or removal channel 129 and thus the piston 128 with the two cams 126 and 127 (FIG. 18) is displaced in the direction of the arrow B. During this operation, the cam 127 which serves to actuate the angle lever 104 (FIG. 13) moves out of the region of the angle lever 104. Now the angle lever 104 cannot be actuated when the rotor 12 including the cam 127 located thereat passes by the anglelever 104 mounted at the stationary housing 14. During the rotation of the rotor 12 the breechblock head 34 (FIG. 13) also moves in the direction of the arrow A, so that the roll 40 engages with the first control cam 89 and the roll 39 abuts against the second control cam 90 (FIG. 13). The breechblock head 34 is thus rotated or turned about its own axis so that it is unlocked in the weapon barrel 11 and simultaneously coupled or locked to the breechblock carrier 33 (FIG. 3). As soon as the breechblock carrier 33 moves in the guide rails 29 (FIG. 2) to the rear again, then the breechblock head 34 is also withdrawn.

However, in the event of an ignition delay or hangflee condition the propellant charge in the cartridge 25 will not be ignited in time when the cartridge 25 is penetrated by the firing pin 45 (FIG. 3). Obviously then, no propellant gas will enter the gas intake or removal channel 129 (FIG. 18). The piston 128 with the cams 126 and 127 is thus not displaced and the cam 127 remains in the operating range of the angle lever 104. This angle lever 104 is therefore actuated and pivoted in counterclockwise direction as shown in FIG. 13 and reaches the position shown in FIG. 14. The lever 99 is also pivoted in counterclockwise direction and disengages itself from the lug or nose 100 so that the plate 91 is displaced from the position shown in FIG. 13 into the position shown in FIG. 14. The control cam 90 is thus inoperative and the breechblock head 34 remains locked in the weapon barrel 11 when the breechblock carrier 33 is withdrawn and moves to the rear.

In the absence of a cartridge 25, no cartridge 2 is penetrated by the ignition or firing pin 45 and, of course, no propellant gas is present in order to displace the piston 128 with the cam 127 and thus move the cam 127 away from the operating range or region of the angle lever 104 (FIG. 3). The cam 127 thus remains in operating range or region of the angle lever 104 and must therefore be pivoted away by other means from such operating range or region of the angle lever 104. This is accomplished as follows: when no cartridges are present, the cam wheels 118 and 123 are in the positions shown in FIG. 16. The cam wheel 118 is in the operative position while the cam wheel 123 assumes the inoperative position. When the rotor 12 rotates in the direction of the arrow A (FIG. 16), the cam 125 abuts against the cam wheel 118 and is pivoted. The cam 127 is also pivoted by the gear rack 130 into its inoperative position thus moving the cam 126 into its operative position as can be seen in FIG. 16. As long as no cartridges 124 are infed or supplied, the cam wheels 118 and 123 as well as the cams 125, 126 and 127 remain in their position as shown in FIG. 16. However, as soon as a cartridge 124 is infed or supplied as shown in FIG. 15, the sensing or feeler wheel 111 is rotated relative to the transfer wheel 110. By this operation, the cam wheels 118 and 123 are also pivoted via the toothed belts 115 and 120 until they assume the position shown in FIG. 15. The cam wheel 123 is thus in the operative position while the cam wheel 118 is in the inoperative position. When the rotor 12 rotates in the direction of the arrow A (FIG. 15) the cam 126 abuts against the cam wheel 123 and is pivoted. The cam 127 is thus turned into its operative position and the cam 125 also reaches its operative position via the gear rack 130. This is of no further importance because the cam wheel 118 is in its inoperative position and thus cannot actuate the cam 125.

From the above description it should be evident that the cam 127 which serves to actuate the angle lever 104

(FIGS. 13 and 14) is only in its operative position when a cartridge has been supplied and when in case of an ignition delay the gas piston or gas actuated piston 128 was not displaced in time.

The mode of operation of the second embodiment of the safety device as described hereinbefore will now be considered and is as follows:

In accordance with FIGS. 1 and 2 of the drawings, the cartridges 25 are supplied to the ammunition infeed or feed housing 26 of the ammunition supply device in the direction of the arrow A. The cartridges 25 are then conveyed along the path of travel of the transfer wheel depicted by circle 137 (FIG. 19) into the weapon housing 14. Within this weapon housing 14, each cartridge 25 is engaged by a related breechblock 50 (FIGS. 11 and 12) 'nd rammed into the related or corresponding weapon barrel 11. During this operation, the rotor 12 rotates in counterclockwise direction as indicated in FIG. 19 by the arrow A. At the position E as illustrated in FIG. 2, the breechblock has reached its forwardmost or foremost position with the assistance of the breechblock control cam 32 (FIG. 2) and the cam follower roll 31. In this position the cartridge 25 is penetrated by the ignition or firing pin 58 (FIG. 7). In case that the propellant charge in the cartridge 25 is ignited in time the pivotable control cam or lever 141 (FIG. 19) is pivoted away by means of the propellant gas from the operative range of the cam 82 located at the actuating ring 76 so that the actuating ring 76 is not rotated. The breechblock head 51 and the breechblock carrier 52 remain coupled to each other. With the assistance of a not particularly shown control cam or the like, the breechblock head 51, in the forwardmost position of the breechblock 50, is rotated via the rolls 66 (FIG. 9) and locked with the related weapon barrel 11. Before the breechblock 50 can be moved to the rear the breechblock head 51 is again unlocked in the weapon barrel 11 via the rolls 66 with the assistance of the same control cam. The breechblock 50 comprising the breechblock carrier 52 and the breechblock head 51 (FIGS. 11 and 12) moves to the rear. The rolls 66 (FIG. 9) actuated by the not particularly shown control cam initially lock the breechblock head 51 via the sleeve 63 with the weapon barrel 11 and then unlock the breechblock head as soon as the cartridge 25 has been fired.

However, in the event of an ignition delay or hangfire condition, the propellant charge in the cartridge 25 will not ignite in time when the cartridge 25 is penetrated by the ignition or firing pin 58 (FIG. 7). Obviously, no propellant gas will enter the gas intake or removal channel 129 and the control cam or lever 141 (FIG. 19) is not pivoted away. When the rotor 12 rotates in counterclockwise direction, the cam 82 of the actuating ring 76 abuts against the control cam or lever 141 and is rotated until the rolls 73 can enter the cut-outs or recesses 81. The breechblock head 51 is thus no longer coupled with the breechblock carrier 52 and therefore remains in the weapon barrel 11 in the locked position when the breechblock carrier 52 is withdrawn and moves to the rear.

In case that no cartridge 25 is delivered or infed, it is evident that no cartridge can be penetrated and no propellant gas exists to actuate the control cam or lever 141 (FIG. 19) away from the operating range or region of the cam 82 located at the actuating ring 76. Nevertheless, the cam 82 must be rotated or turned away from the operating range of the control cam or lever 141 and this can be implemented as follows: when no cartridge 124 is supplied, the sensing or feeler lever 138 will not be actuated. The result is that the control cam 140 moves into its front position and the control cam 139 is retracted. As shown in FIG. 19, two cartridges 124 are in the operating region or range of the sensing or feeler lever 138 so that the control cam 139 is shown in its front position and the control cam 140 is shown in its rear position.

The moment the control cam 140 reaches its forwardmost position, the cam **83*a* abuts against the front control edge or portion 140*a* of the control cam 140 and subsequently the cam 83*b* abuts against the rear control edge or portion 140*b* of the control cam 140. In this manner, the actuating ring 76 is rotated by 90° and the cam 82, which could be termed the hangfire control cam, moves away from the operating range of the control cam or lever 141. However, as soon as a cartridge is supplied, the sensing or feeler lever 138 is actuated and, as shown in FIG. 19, the control cam 139 assumes its foremost position and the control cam 140 is withdrawn. When the rotor 12 rotates with the breechblock 50 in counter clockwise direction, then the actuating ring 76 with its first cam 84*a* abuts against the front control edge or portion 139*a* and subsequently with its second cam 84*b* against the rear control edge or portion 139*b* of the control cam 139. During this operation, the actuating ring 76 is rotated by exactly 90° and the cam 82**, the so-called hangfire control cam, can assume its operative position.

From the above description it should be evident that the hangfire control cam 82 is only then in its operative position when a cartridge 124 is present. Should this cartridge 124 not be ignited in time, then the control cam or lever 141 is in a position to rotate the actuating ring 76 by only 45° and thus to decouple the breechblock head 51 from the breechblock carrier 52.

While there are shown and described present preferred embodiments of the invention, it is to be distinctly understood that the invention is not limited thereto, but may be otherwise variously embodied and practiced within the scope of the following claims.

Accordingly, what we claim is:

1. A safety apparatus for an externally powered firing weapon including a weapon barrel and into which cartridges are insertable which may be subject to ignition delay, said safety apparatus comprising:

a breechblock positively reciprocating between a forwardmost position and a rearmost position;

means for locking said breechblock to said weapon barrel in said forwardmost position;

said breechblock comprising a breechblock carrier and a breechblock head which are operatively coupled to each other;

means for decoupling said breechblock carrier from said breechblock head in said forwardmost position in which said breechblock head is locked to said weapon barrel in response to an ignition delay of a cartridge located in the breechblock;

said decoupling means automatically decoupling said breechblock carrier from said breechblock head when said breechblock head locks to said weapon barrel; and said decoupling means responding to said ignition delay including means for preventing the unlocking of said breechblock head from the weapon barrel and the coupling of said breechblock carrier with said breechblock head.

2. The safety apparatus as defined in claim 1, further including, a weapon housing cooperating with said breechblock;

said means for locking said breechblock to said weapon barrel comprises:

two control rolls provided at said breechblock head for locking and unlocking said breechblock head to said weapon barrel;

a first control cam stationarily mounted with respect to the weapon housing;

a second control cam displaceably mounted with respect to said weapon housing;

said first control cam being engageable with one of said two control rolls for locking said breechblock head; and said second control cam being engageable with the other of said two control rolls for unlocking said breechblock head and being displaceable from an operative position into an inoperative position in order to prevent unlocking of said breechblock head.

3. The safety apparatus as defined in claim 2, further including:

a displaceable plate on which said second control cam is located;

means defining two control grooves in which said displaceable plate is displaceable in radial and tangential direction relative to said breechblock;

a lever movably mounted at said displaceable plate;

a spring acting upon said lever;

a stop lug located at said weapon housing; and said second control cam being held by said lever and said stop lug in an operative position against the force of said spring.

4. The safety apparatus as defined in claim 1, further including:

a cartridge transfer wheel for the infeed of cartridges;

said means for decoupling said breechblock carrier from said breechblock head locked to said weapon barrel including sensing means for determining whether a cartridge has been infed;

said sensing means comprising a sensing wheel which is substantially coaxially arranged with respect to said cartridge transfer wheel;

said teeth of said sensing wheel having teeth and tooth gaps between said teeth;

said cartridge transfer wheel having teeth and tooth gaps between said teeth; and said teeth of said sensing wheel overlying the gaps of said cartridge transfer wheel when a cartridge has not been infed.

5. The safety apparatus as defined in claim 4, further including:

power transmission means;

a plurality of synchronously rotating cam wheels;

said sensing wheel being connected by means of said power transmission means with said plurality of synchronously rotating cam wheels;

a plurality of control cams;

a first one of said synchronously rotating cam wheels pivoting at least predeterminate ones of said plurality of control cams into an operative position; and a second one of said synchronously rotating cam wheels pivoting at least predeterminate ones of said plurality of control cams into an inoperative position.

6. A safety apparatus for an externally powered weapon including a weapon barrel and into which cartridges are insertable which may be subject to ignition delay, said safety apparatus comprising:

a breechblock positively reciprocating between a forwardmost position and a rearmost position;

means for locking said breechblock to said weapon barrel in said forwardmost position;

said breechblock comprising a breechblock carrier and a breechblock head which are operatively coupled to each other;

means for decoupling said breechblock carrier from said breechblock head in said forward most position in which said breechblock head is locked to said weapon barrel in response to an ignition delay of a cartridge located in the breechblock;

said means for locking the breechblock to the weapon barrel comprising rotary locking means for locking said breechblock head to said weapon barrel; and said means for decoupling said breechblock carrier from said breechblock head including rotary coupling means for coupling said breechblock head to said breechblock carrier.

7. The safety apparatus as defined in claim 6, wherein:

said rotary coupling means comprising cam means provided at said breechblock head and cams means provided at said breechblock carrier; and said cams means of said breechblock head and said cam means of said breechblock carrier interengaging with one another to form a bayonet type lock for coupling said breechblock head to said breechblock carrier.

8. The safety apparatus as defined in claim 7, wherein:

said breechblock carrier has a front end region and a circumference;

said breechblock head has a rear end region and a circumference;

said breechblock carrier being provided at the front end region thereof with a number of outer cams defining said cam means thereof and substantially uniformly distributed at the circumference thereof;

said breechblock head being provided at the rear end region thereof with a number of inner cams defining the cam means thereof and corresponding to the number of outer cams and substantially uniformly distributed at the circumference of the breechblock head; and said outer cams operatively engaging with said inner cams to provide said bayonet type lock for coupling said breechblock head to said breechblock carrier.

9. The safety apparatus as defined in claim 6, further including:

a rotatable and non-axially displaceable sleeve provided for said breechblock carrier; and said rotatable and non-axially displaceable sleeve being coupled to said breechblock head and serving for locking and unlocking said breechblock head in said weapon barrel.

10. The safety apparatus as defined in claim 9, further including:

a housing provided for the breechblock head;

a plurality of locking elements for coupling said sleeve to said breechblock head;

said sleeve being provided with cut-outs;

said housing being provided with cut-outs;

said locking elements partially protruding into said cut-outs at said sleeve and partially protruding into said cut-outs at the housing of said breechblock head;

an actuating ring for retaining said locking elements in said cut-outs of said sleeve; and said actuating ring further comprising cut-outs into which said locking elements protrude when said breechblock head is decoupled from said sleeve.

11. The safety apparatus as defined in claim 10, wherein:

said actuating ring has a circumference;

said decoupling means including three rows of cams which are located on the circumference of said actuating ring;

a first row of said three rows of cams serving to rotate said actuating ring into an operative position;

a second row of said three rows of cams serving to rotate said actuating ring into an inoperative position; and a third row of said three rows of cams serving to decouple said breechblock carrier from said breechblock head when said actuating ring assumes said operative position and an ignition delay is encountered.

* * * * *

UNITED STATES PATENT AND TRADEMARK OFFICE

CERTIFICATE OF CORRECTION

PATENT NO. : 4,841,835

DATED : June 27, 1989

INVENTOR(S) : ERWIN BOHLER et al

It is certified that error appears in the above-identified patent and that said Letters Patent is hereby corrected as shown below:

Column 5, line 51, after "25" please delete ":1"

Column 7, line 40, after "84" please delete "ill" and insert --will--

Column 10, line 14, please delete "ons" and insert --on--

Column 12, line 31, after "cartridge" (2nd occurrence), please delete "2" and insert --25--

Column 13, line 16, after "12)" please delete "'nd" and insert --and--

Signed and Sealed this

Tenth Day of April, 1990

*Attest:*

HARRY F. MANBECK, JR.

*Attesting Officer*

*Commissioner of Patents and Trademarks*